US007210948B2

(12) United States Patent
Nishide

(10) Patent No.: US 7,210,948 B2
(45) Date of Patent: May 1, 2007

(54) CONNECTOR AND CONNECTOR ASSEMBLY

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/328,967

(22) Filed: Jan. 9, 2006

(65) Prior Publication Data

US 2006/0154505 A1 Jul. 13, 2006

(30) Foreign Application Priority Data

Jan. 11, 2005 (JP) ..... 2005-004305

(51) Int. Cl.
*H01R 13/62* (2006.01)

(52) U.S. Cl. ..... 439/157; 439/341

(58) Field of Classification Search ..... 439/157, 439/159, 341
See application file for complete search history.

(56) References Cited

U.S. PATENT DOCUMENTS 5,269,696 A 12/1993 Okada et al.
6,644,992 B2 * 11/2003 Maegawa ..... 439/157

* cited by examiner

*Primary Examiner*—Truc Nguyen
(74) *Attorney, Agent, or Firm*—Gerald E. Hespos; Anthony J. Casella

(57) ABSTRACT

A moving plate (30) has a substantially rectangular bottom portion (38) and a surrounding wall (32) projecting from the outer periphery of the bottom portion (38). Shake preventing projections (37) are formed on the opposite outer side surfaces of the surrounding wall (32) including the shorter sides of the bottom portion (38) and extend from an upper edge of the surrounding wall (32) over the entire vertical length. The height of the shake preventing projections (37) exceeds a corresponding clearance dimension between the surrounding wall (32) and a receptacle (11). A lever (20) is used to realize a smooth connecting operation by preventing the moving plate (30) from being inclined while two housings (10, 40) are being connected.

15 Claims, 11 Drawing Sheets

CONNECTOR AND CONNECTOR ASSEMBLY

BACKGROUND OF THE INVENTION

1. Field of the Invention

The invention relates to a connector and to a connector assembly.

2. Description of the Related Art

U.S. Pat. No. 5,269,696 discloses a multi-contact connector with a male housing and a moving plate movably disposed in the male housing. Male terminal fittings are mounted in male housing, and tabs of the male terminal fittings penetrate through the moving plate. Thus, the moving plate protects and positions the tabs.

A conventional moving plate is smaller than the receptacle by a specified amount to ensure that the moving plate can be inserted easily into the receptacle. However, this clearance can cause the moving plate to incline and move less smoothly. A smaller clearance will make the moving plate less likely to incline, but can complicate the insertion of the moving plate into the receptacle.

The invention was developed in view of this problem, and an object thereof is to ensure easy insertion of the moving plate without inclination.

SUMMARY OF THE INVENTION

The invention relates to a connector with a housing that has a receptacle for receiving a mating housing. A moving plate is disposed in the receptacle for positioning terminal fittings in the receptacle. The moving plate is moveable together with the mating housing towards the back side of the receptacle while the housing and the mating housing are being connected. Shake preventing projections are provided on at least the outer peripheral surface of the moving plate or the inner peripheral surface of the receptacle.

The shake preventing projections preferably are provided substantially symmetrically on at least the outer peripheral surface of the moving plate or the inner peripheral surface of the receptacle.

The shake preventing projections prevent inclination of the moving plate that might otherwise be attributable to the clearance. The moving plate and the receptacle contact only at the shake preventing projections. Thus, contact resistance with the mating, side is suppressed and insertion is easy.

The housing preferably is a male housing with a receptacle, and the mating housing preferably is a female housing that can fit into the receptacle. The moving plate preferably is configured for positioning male terminal fittings in the receptacle. The female housing and the moving plate move together toward the back side of the receptacle while the male and female housings are being connected.

A surrounding wall preferably is formed on the outer periphery of the moving plate and extends along the inner peripheral surface of the receptacle. The shake preventing projections preferably are formed on the surrounding wall of the moving plate and extend substantially along a moving direction of the moving plate and the connection direction of the two housings. The surrounding wall substantially prevents inclination of the moving plate and ensures that the moving plate can be moved stably towards the back side of the receptacle.

A movable member preferably is mounted movably on the housing and interacts with a cam follower on the mating housing to assist connection of the housing with the mating housing. The shake preventing projections may increase contact resistance. However, the movable member functions as a force multiplying member and alleviates any increase in the operation load.

The housing preferably has at least one escaping groove that extends from the opening end of the receptacle and the cam follower preferably has at least one cam pin formed on the moving plate. The cam pin can fit into the escaping groove. More particularly, at least one cam pin of the mating housing preferably passes through the escaping groove and unites with the cam pin of the moving plate to form an integral cam follower when the two housings are being connected.

The movable member preferably comprises a lever rotatably supported on the outer surface of the housing.

The movable member preferably is operated while the cam follower engages the cam groove of the movable member. Thus, the mating housing is connected with the housing while moving together with the moving plate.

The moving plate preferably is substantially rectangular, and the shake preventing projections are provided on portions of the surrounding wall corresponding to shorter sides of the moving plate. The cam pin preferably is provided on a side of the surrounding wall corresponding to a longer side of the moving plate.

The moving plate could make a pivotal movement with the cam pin as an axis of rotation. However, inclination of the plate can be prevented efficiently because the shake preventing projections are on the shorter sides where the pivotal displacement is expected to be largest.

The height or projecting distance of the shake preventing projections is set so that the shake preventing projections can bite in and deform the inner peripheral surface of the receptacle. Thus, inclination of the moving plate is prevented securely.

The invention also relates to a connector assembly comprising the above-described connector and a mating connector with a mating housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
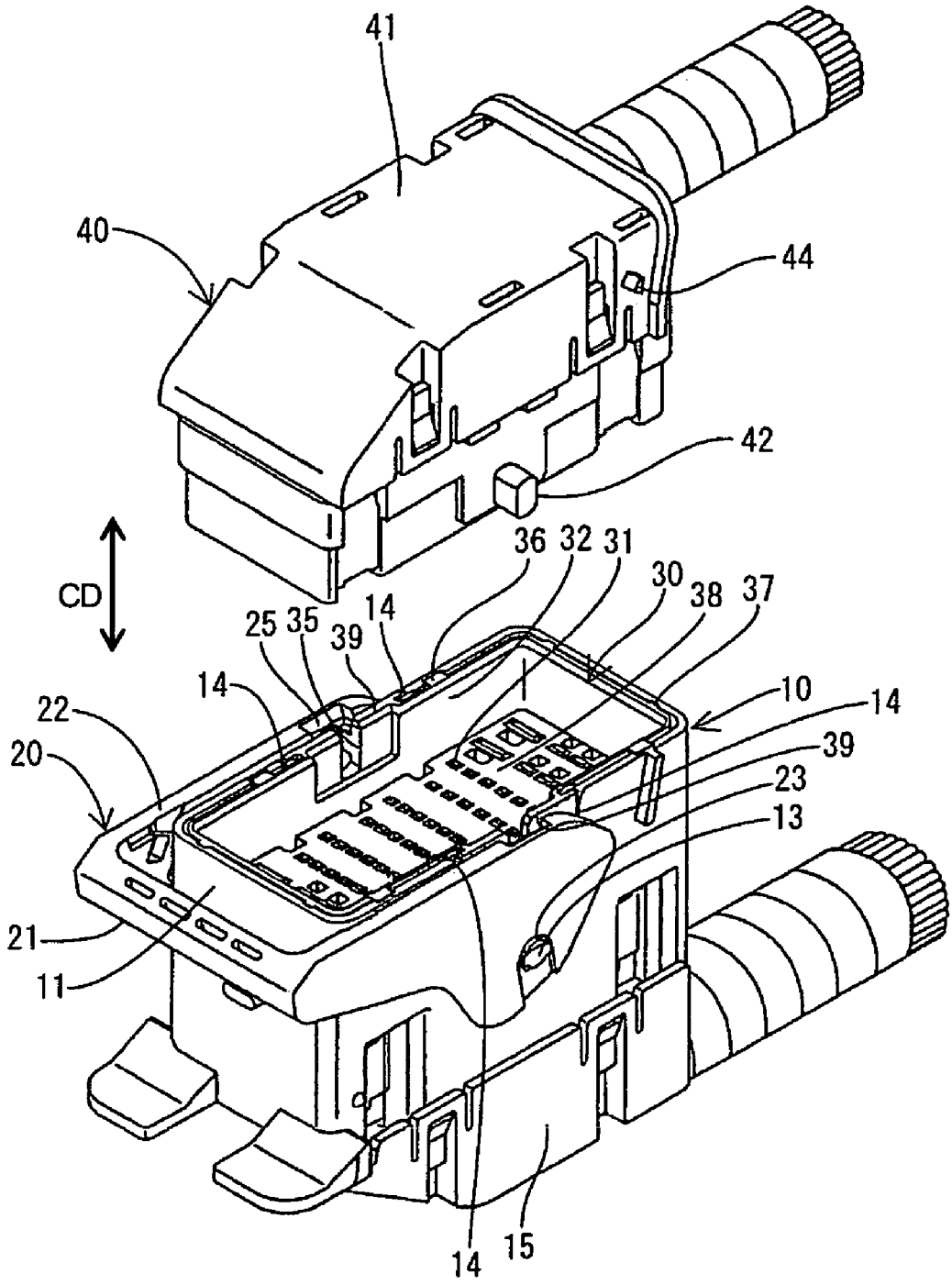
FIG. 1 is a perspective view of a lever-type connector according to one embodiment of the invention before being connected.
Figure 2:
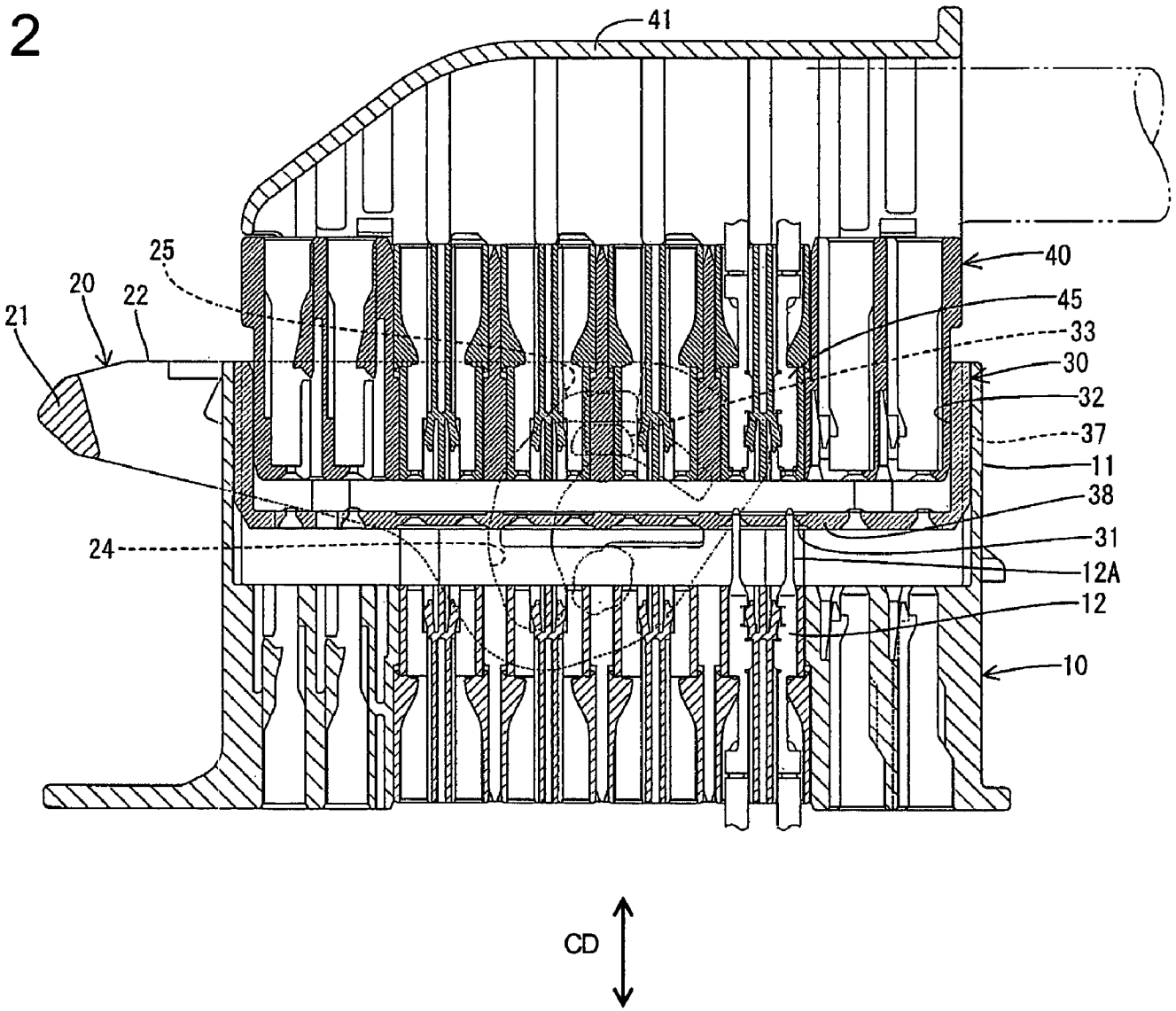
FIG. 2 is a section showing a state where a lever is at a connection starting position.
Figure 3:
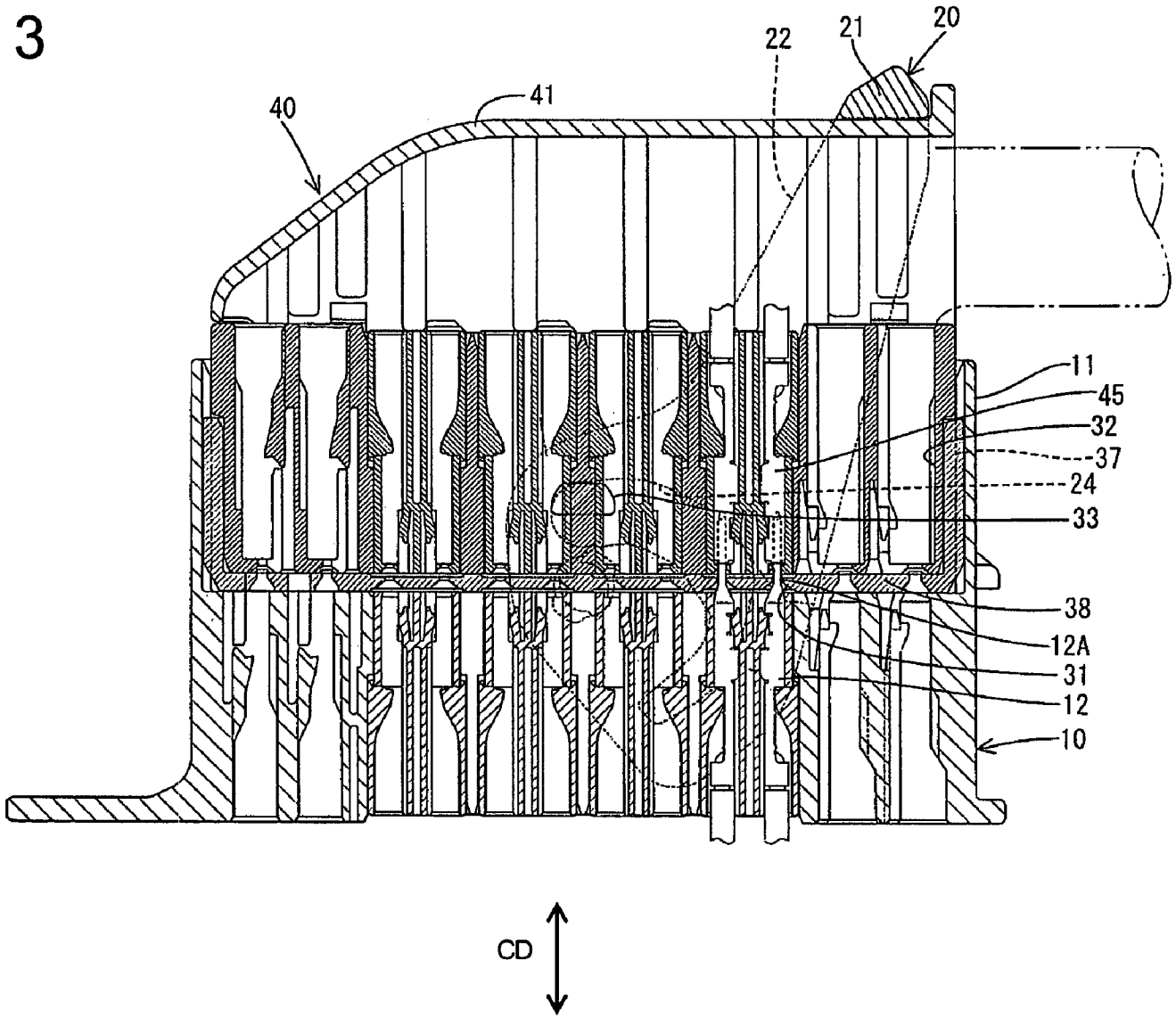
FIG. 3 is a section showing a state where the lever is at a connection ending position.
Figure 6:
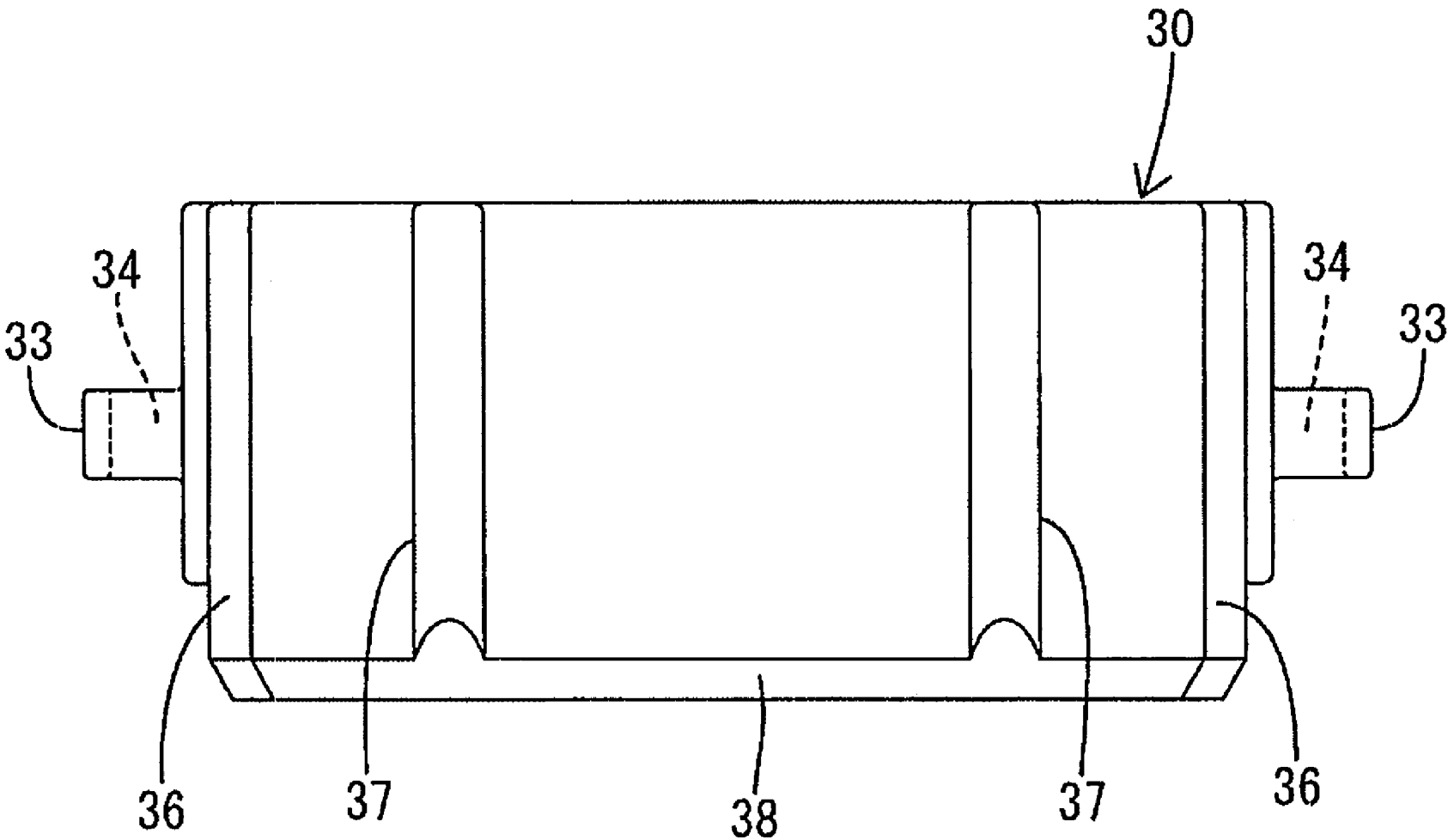
FIG. 6 is a front view of the moving plate.
Figure 7:
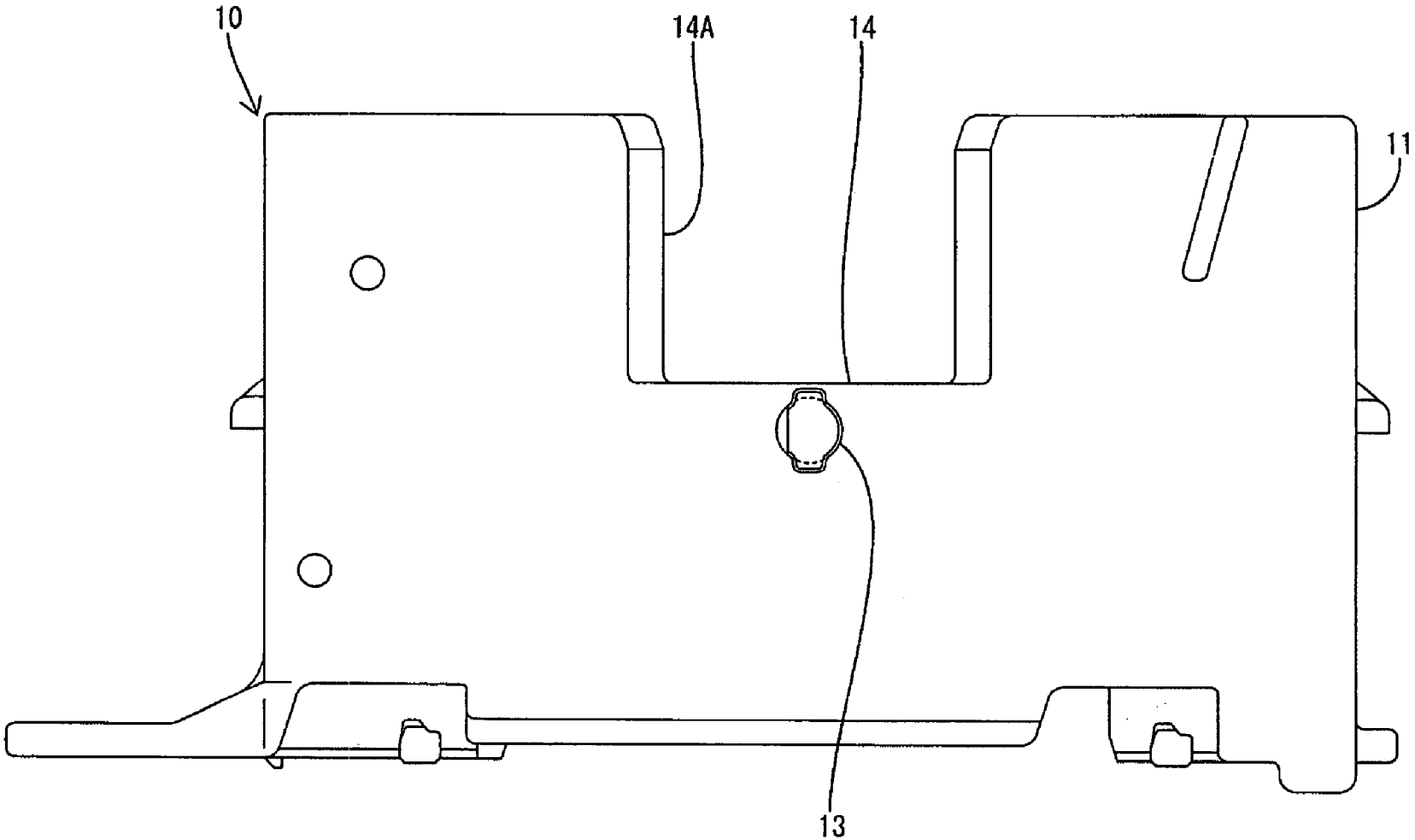
FIG. 7 is a side view of a male connector housing.

A lever-type connector according to the invention is illustrated in FIGS. 1 to 11. The connector has a male housing 10 with an upwardly open receptacle 11 of substantially rectangular cross section. Male terminal fittings 12 are mounted in the male housing 10 so that male tabs 12A of the male terminal fittings 12 project up along a connecting direction CD in the receptacle 11. A moving plate 30 is accommodated in the receptacle 11 for movement vertically substantially along the connecting direction CD while permitting the male tabs 12A to penetrate through the moving plate 30. Two shafts 13 project from the opposite outer side surfaces of the male housing 10 that correspond to the longer sides of the receptacle 11 and two escaping grooves 14 are formed in these surfaces. The escaping grooves extend substantially straight and vertically along the connecting direction CD towards the shafts 13 from the upper ends of these surfaces, as shown in FIG. 7. A wire cover 15 is mounted on the bottom surface of the male housing, as shown in FIG. 1.

Figure 8:
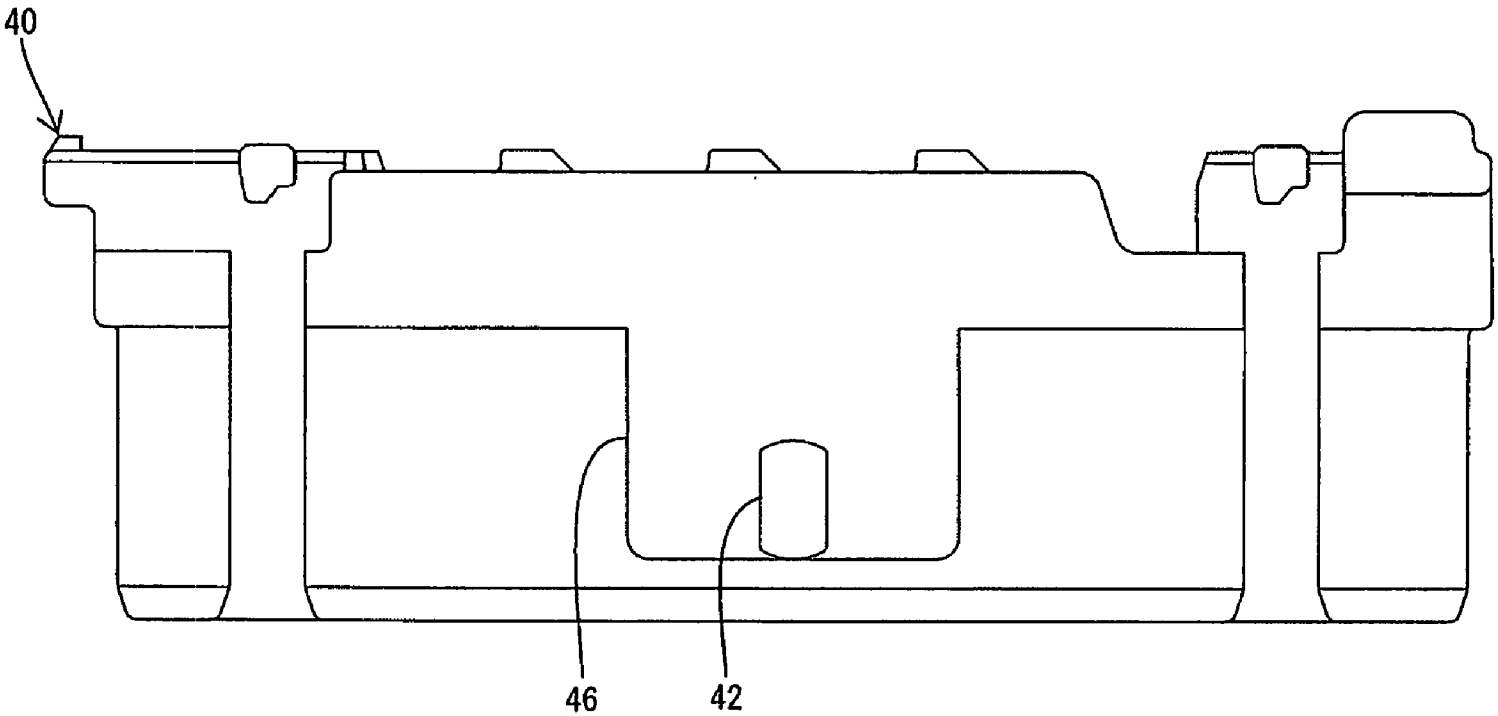
FIG. 8 is a side view of a female connector housing.
Figure 9:
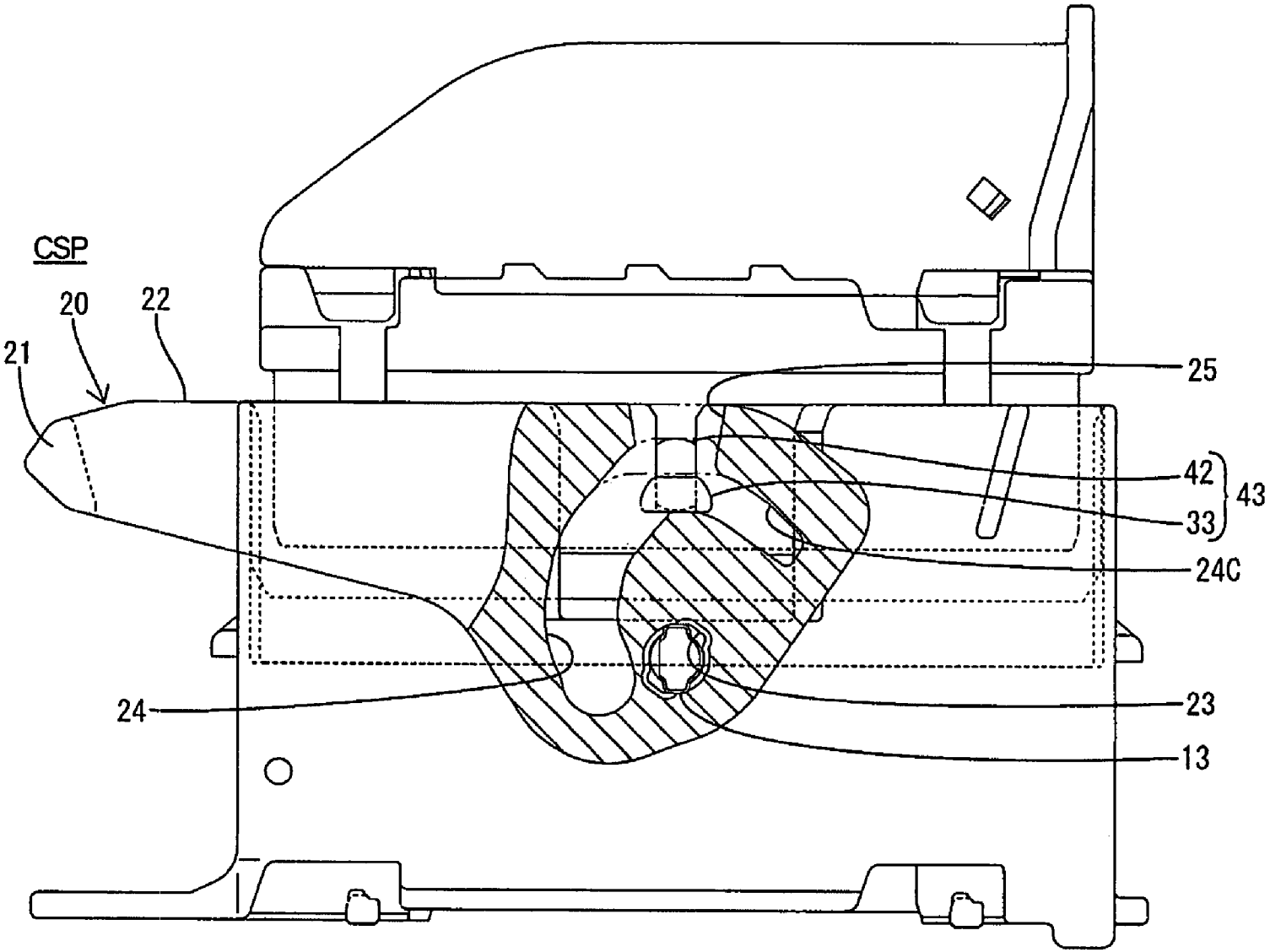
FIG. 9 is a side view partly in section showing the state where the lever is at the connection starting position.
Figure 10:
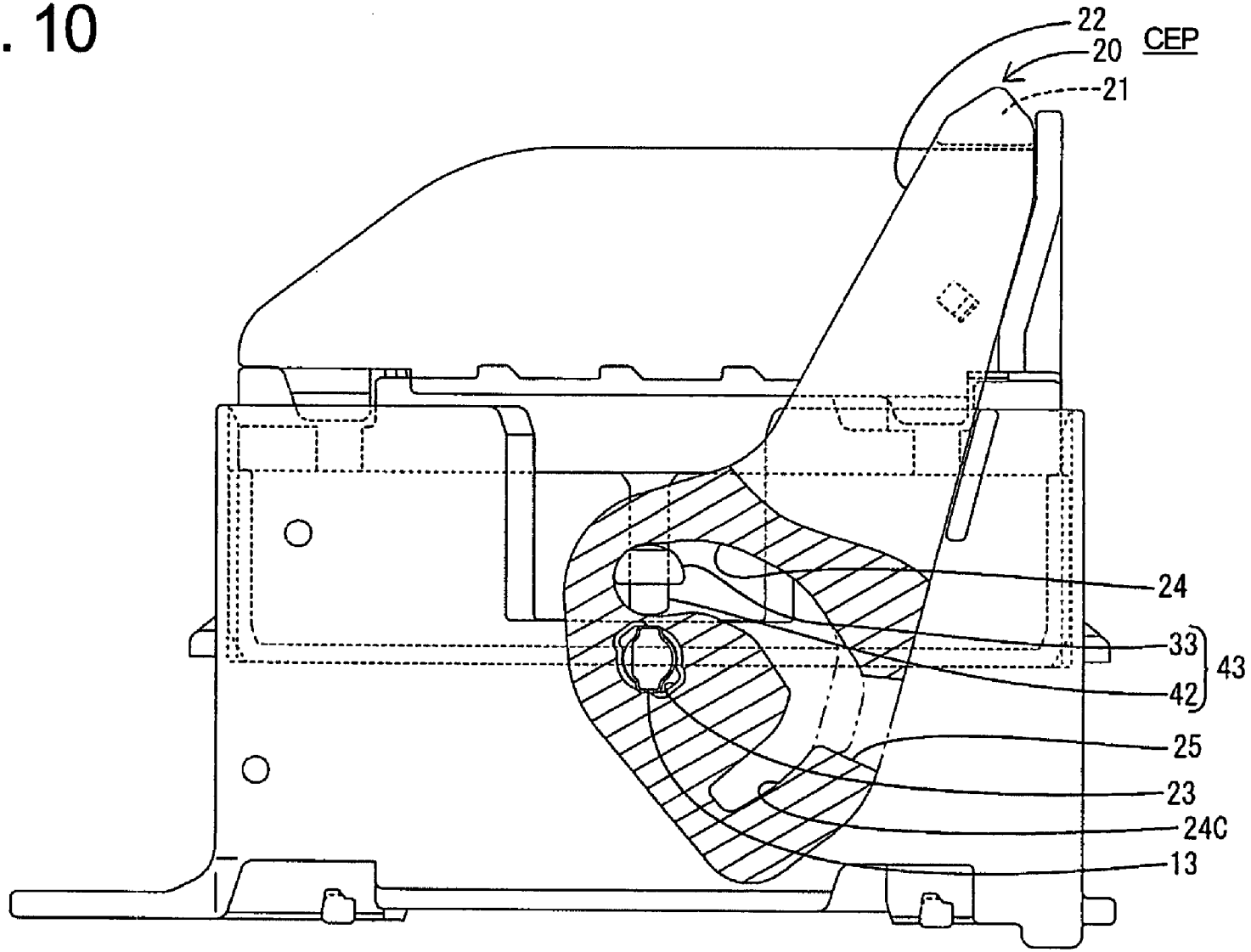
FIG. 10 is a side view partly in section showing the state where the lever is at the connection ending position.
Figure 11:
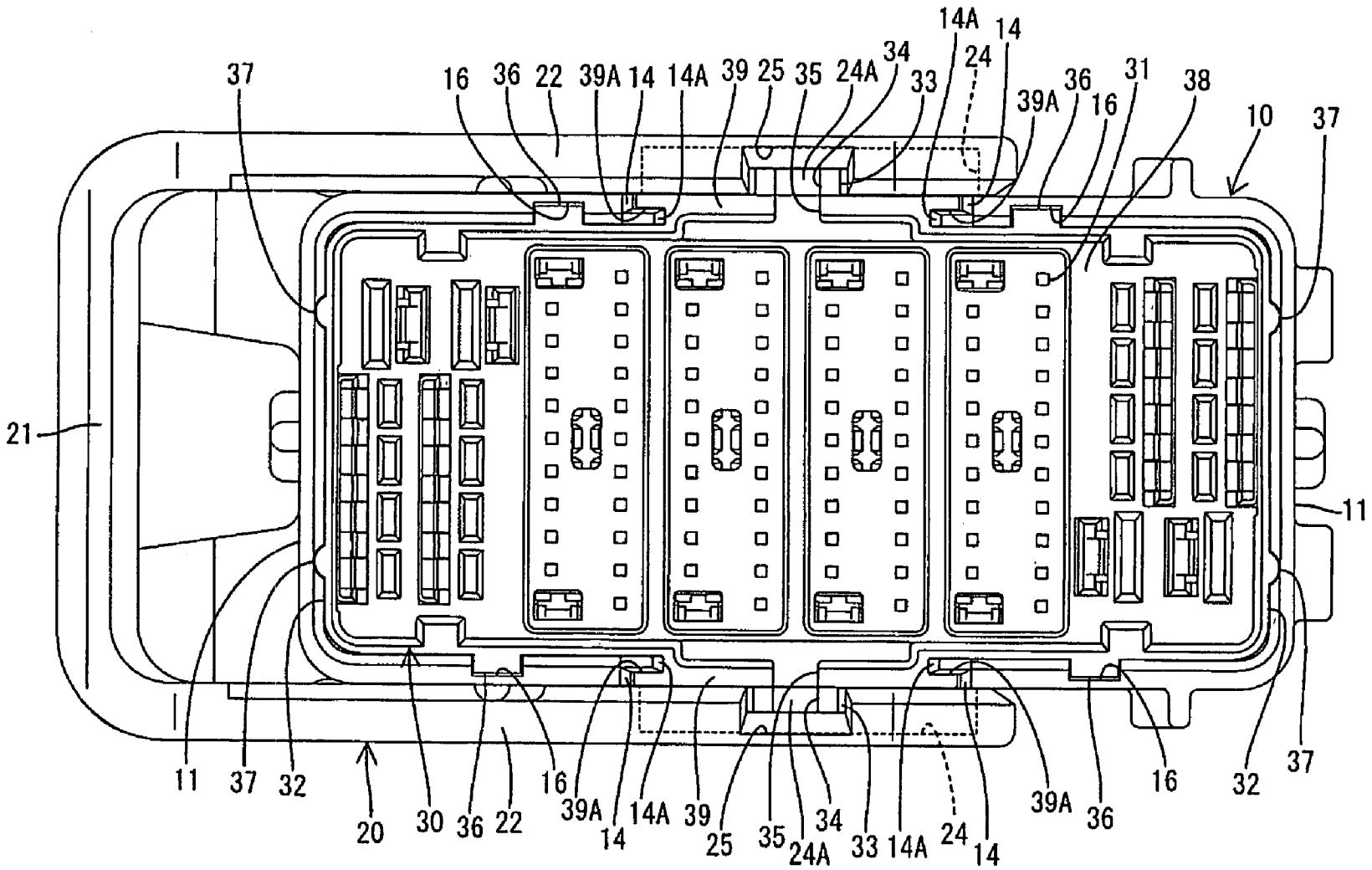
FIG. 11 is a plan view showing a state where the moving plate is mounted in the male connector housing.

A female housing 40 is formed to fit into the male housing 10, and female terminal fittings 45 are accommodated in the female housing 40 for connection with the male terminal fittings 12. A wire cover 41 is mounted on a surface of the female housing 40 substantially opposite a mating surface with the male housing 10 to specify a drawing direction of wires connected with the female terminal fittings 45. Steps 46 project out slightly from widthwise intermediate parts of side surfaces of the female housing 40, as shown in FIG. 8 and cam pins 42 project from intermediate positions of the bottoms of the steps 46. The cam pins 42 are columns of substantially elliptic cross section The connector also includes a lever 20 with an operable portion 21 and two plate-shaped arms 22 that extend from opposite ends of the operable portion 21. Bearing holes 23 are formed close to the base ends of the arms 22. The bearing holes 23 can be mounted rotatably to the shafts 13 of the male housing 10 so that the lever 20 can be rotated between a connection starting position CSP (FIG. 9) and a connection ending position CEP (FIG. 10). Furthermore, the lever 20 can be locked releasably at both positions. Cam grooves 24 are formed in the inner surfaces of the arms 22 and partly surround the bearing holes 23. Entrances 25 of the cam grooves 24 face towards the mating housing along the connecting direction CD to permit entry of cam pins 33, 42 when the lever 20 is at the connection starting position CSP. The cam grooves 24 extend clockwise and opposite to a rotating direction from the connection starting position CSP to the connection ending position CEP. Each cam groove 24 has an extended area 24C for receiving the cam pin 33, and the lever 20 can be mounted to the male housing 10 at the ends of the extended areas 24C. Specifically, the shafts 13 and the bearing holes 23 are aligned substantially congruently at a position where the lever 20 can be mounted so that the shafts 13 can fit into the bearing holes 23. However, the shafts 13 and the bearing holes 23 are not aligned congruently between the connection starting position CSP and the connection ending position CEP to hold the lever 20 engaged. At the position where the lever 20 can be mounted, the lever 20 is rotated so that a cam follower 43 is moved into the extended areas 24C to avoid causing the leading end of the lever 20 to project from the outer side surface of the male housing 10 (e.g. by arranging it in a close relationship to the male housing 10).

The moving plate 30 has a substantially rectangular bottom wall 38 formed with positioning holes 31 that receive and position the male tabs 12A in the receptacle 11. A surrounding wall 32 projects up substantially normal to the bottom wall 38 and extends around substantially the entire periphery of the bottom wall 38. The surrounding wall 32 is formed so that substantially the entire outer periphery of the surrounding wall 32 extends along the inner surfaces of the receptacle 11. Bulges 39 are formed at positions on the surrounding wall 32 corresponding to the escaping grooves 14 (see FIGS. 4 and 5), and can fit into the respective escaping grooves 14. Holding edges 39A bulge out over substantially the entire height range at the opposite widthwise ends of each bulge 39 (see FIGS. 4 and 11), and opening edges 14A of the escaping groove 14 are held tightly held between the surrounding wall 32 and the holding edges 39A to guide the movement of the moving plate 30.

Figure 4:
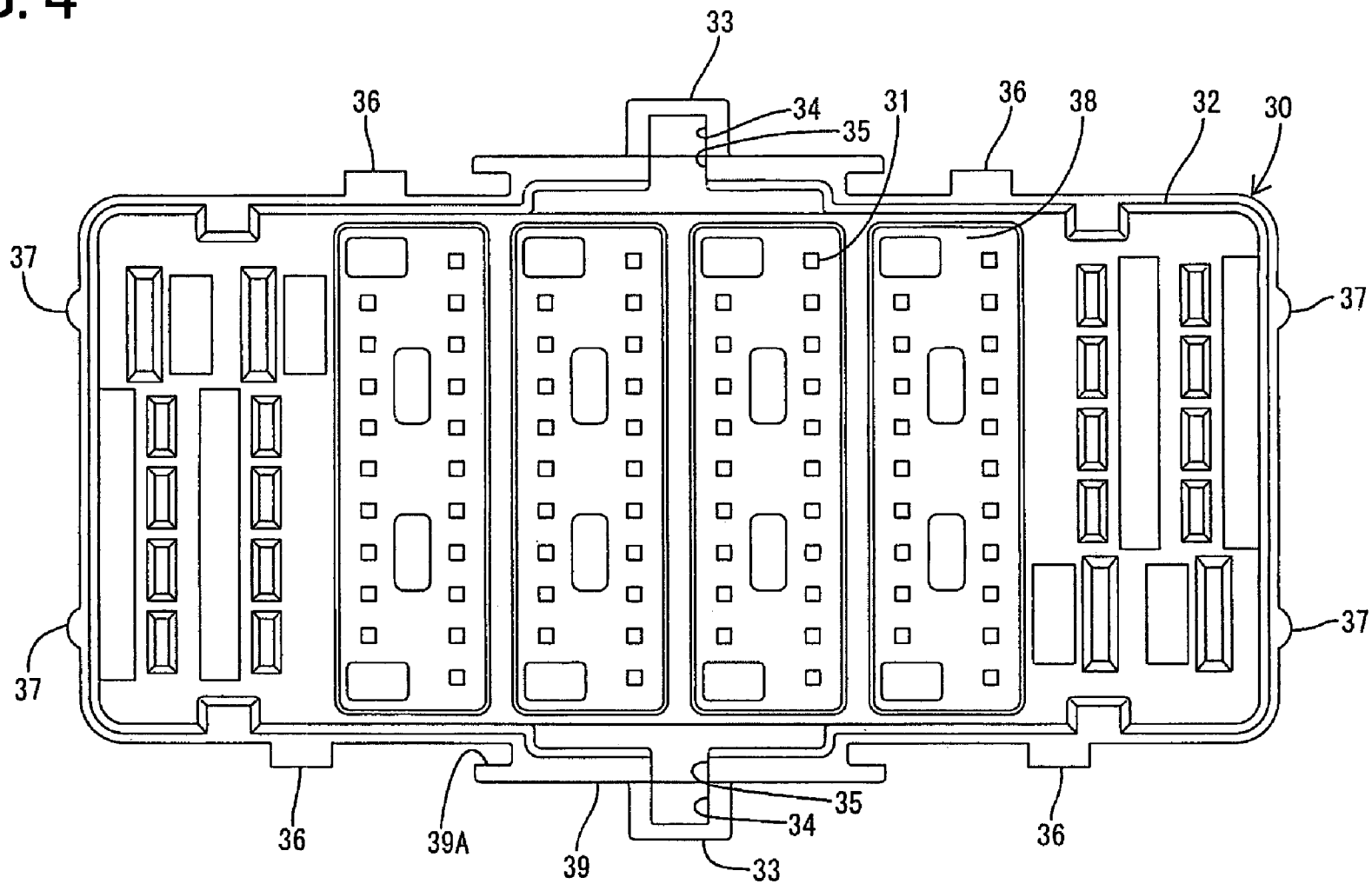
FIG. 4 is a plan view of a moving plate.
Figure 5:
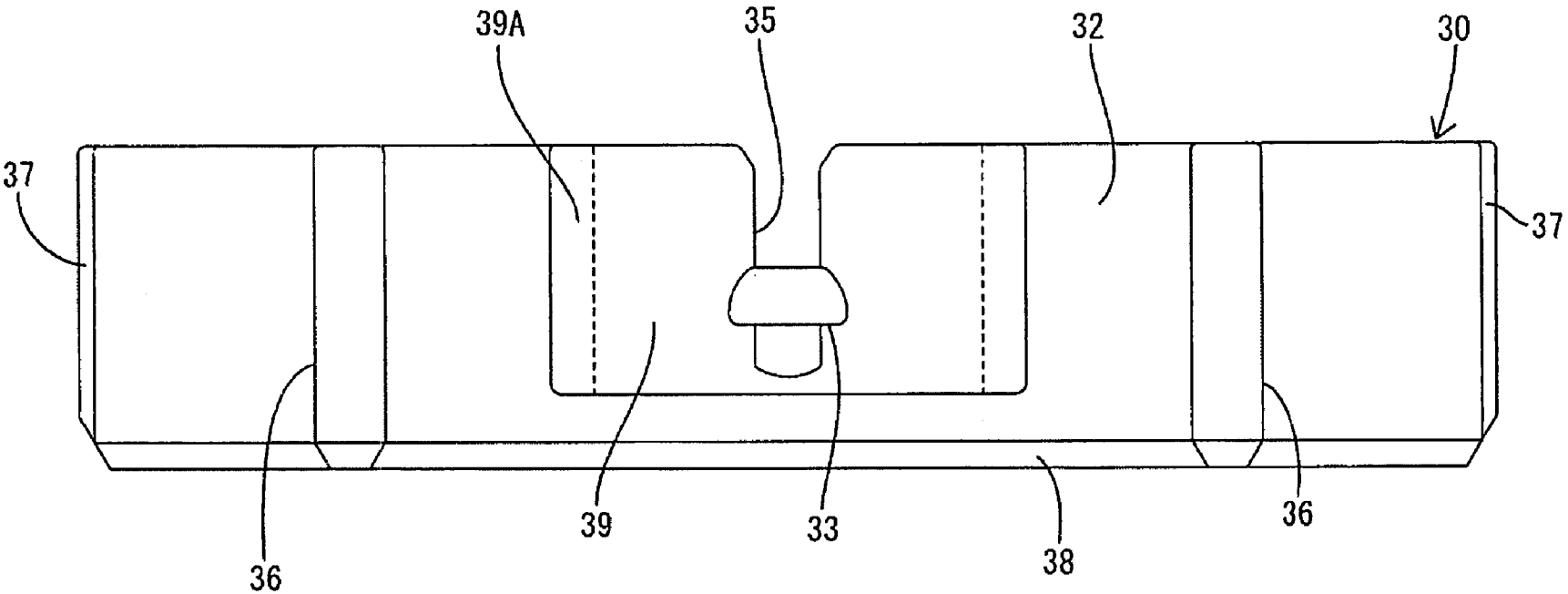
FIG. 5 is a side view of the moving plate.

An introducing groove 35 is formed substantially in the widthwise center of each bulge 39 and extends substantially vertically along the connecting direction CD. Each introducing grooves 35 is open at the upper edge of the bulge 39 to receive the cam pins 42 of the female housing 40. The cam pin 33 is formed at the bottom of each introducing groove 35 to cross over the introducing groove 35. The cam pins 33 are U-shaped, as shown in FIG. 4, and inner spaces thereof define fitting recesses 34 to receive the cam pins 42. Entry of the cam pins 42 into the fitting recesses 34 enable the cam pins 33 and the cam pins 42 to unite as cam followers 43 that function together throughout the connection of the two housings 10, 40. The lever 20 is moved to the connection ending position CEP after the cam followers 43 are introduced into the cam grooves 24. As a result, the cam followers 43 move along the cam grooves 24 to display a cam action for connecting the two housings 10, 40. At this time, the steps 46 of the female housing 40 are fit to extend along the inner side surfaces of the bulges 39. Guiding projections 36 are provided at the opposite widthwise sides of each bulge 39 and extend substantially vertically along the connecting direction CD over substantially the entire vertical length of the surrounding wall 32. Each guiding projection 36 has a substantially rectangular cross section. As shown in FIG. 4, two guiding projections 36 are provided at each side of the surrounding wall 32. The distance between the guiding projections 36 on one side of the surrounding wall 32 differs from the distance between the guiding projections 36 on the other side to prevent and inverted mounting of the moving plate 30 into the male housing 10.

As shown in FIG. 6, two spaced-apart shake preventing projections 37 are formed on the shorter outer side surfaces of the surrounding wall 32. The shake preventing projections 37 are columns of substantially semicircular cross section and extend over substantially the entire vertical length of the surrounding wall 32. The height of the shake preventing projections 37 is slightly larger than a corresponding dimension of a clearance between the receptacle 11 and the surrounding wall 32. Hence, the shake preventing projections 37 can be pressed into contact with the inner side surfaces of the receptacle 11 over substantially their entire lengths.

The male and female housings 10, 40 are connected with each other after the lever 20, the moving plate 30 and the wire cover 15 are assembled with the male housing 10. The female housing 40 is fit lightly into the receptacle 11. As a result, the cam pins 42 pass through the escaping grooves 14 and the introducing grooves 35 of the moving plate 30 and unite with the cam pins 33 to form the cam followers 43. If the lever 20 is pivoted in this state, the female housing 40 is pulled into the receptacle 11. The two housings 10, 40 are connected properly when the lever 20 reaches the connection ending position CEP.

The guiding projections 36 of the moving plate 30 engage the respective receiving portions 16 and tightly hold the opening edges 14A of the escaping grooves 14 between the surrounding wall 32 and the holding edges 39A to guide the movement of the moving plate 30. The shake preventing projections 37 can move between the surrounding wall 32 of the moving plate 30 and the receptacle 11 while sliding in contact with the inner surfaces of the receptacle 11. Thus, movement of the moving plate 30 in an inclined posture is prevented. Further, the dimension of the shake preventing projections 37 along the connecting direction CD is larger than the corresponding dimension of the clearance between the surrounding wall 32 of the moving plate 30 and the receptacle 11. Thus, there is a possibility of increasing an operation load due to an increased resistance due to the sliding contact. These dimensions are set in view of molding errors or assembling error of the moving plate 30 and the receptacle 11. However, the increased resistance resulting from the overlaps is canceled by a force multiplying mechanism of the lever 20.

The lever 20 engages the protuberances 44 of the wire cover 41 of the female housing 40 when the lever 20 reaches the connection ending position. Thus, the lever 20 is locked releasably at the connection ending position CEP.

As described above, the shake preventing projections 37 are on the surrounding wall 32 of the moving plate 30 and prevent the moving plate 30 from shaking due to peripheral clearances. Further, the moving plate 30 and the receptacle 11 contact only at the shake preventing projections 37. Therefore, contact resistance is low. The projecting distance of the shake preventing projections 37 exceeds the corresponding dimension of the clearance between the surrounding wall 32 and the receptacle 11 to prevent the moving plate 30 from tilting. Any increase in connection resistance resulting from this setting is offset by the lever 20. The shake preventing projections 37 are at the shorter sides of the moving plate 30 where a pivotal displacement is expected to be largest. Thus, the move plate 30 should not pivot about the cam pins 33.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shake preventing projections are on the moving plate in the foregoing embodiment, but they may be in the receptacle.

The shake preventing projections are on the shorter sides of the surrounding wall in the foregoing embodiment. However, they may be on the longer side surfaces of the surrounding wall.

The shake preventing projections have a substantially semicircular cross section in the foregoing embodiment. However, they may have another shape that can suppress a contact area and may, for example, have a rounded, triangular or substantially polygonal section.

The shake preventing projections extend over the entire vertical length of the surrounding wall in the foregoing embodiment, but they may extend along part of the entire vertical length of the surrounding wall.

The lever is mounted rotatably to the housing in the foregoing embodiment. However, any other movable member displaying a cam action or force multiplying force may be provided, such as a slider or a movable member movable along a substantially linear, elliptical or other path.

The invention is equally applicable to female connectors in which female terminal fittings are supported by a movable plate.

What is claimed is:

1. A connector, comprising:

a housing including a receptacle for receiving a mating housing, the receptacle having two opposed side walls and two opposed end walls extending continuously between and joining the side walls to define an inner peripheral surface for the receptacle;

a lever mounted rotatably on at least one of the side walls of the housing and configured to assist a connection of the housing with the mating housing; and a moving plate for positioning terminal fittings in the receptacle, the moving plate being moveable together with the mating housing towards a back side of the receptacle while the housing is being connected to the mating housing, the moving plate having a surrounding wall defining outer peripheral end surfaces opposed to the end walls of the receptacle; and shake preventing projections provided on at least one of the outer peripheral end surfaces the moving plate and at least one of the end walls defining the inner peripheral surface of the receptacle.

2. The connector of claim 1, wherein the shake preventing projections are dimensioned to bite in and deform the inner peripheral surface of the receptacle.

3. A connector assembly comprising the connector of claim 1 and a mating connector having a mating housing connectable therewith.

4. The connector of claim 1, wherein the shake preventing projections are formed on the surrounding wall of the moving plate and extend substantially along a moving direction of the moving plate.

5. The connector of claim 4, wherein the lever is configured to interact with a cam follower on the mating housing to assist a connection of the housing with the mating housing.

6. The connector of claim 5, wherein the housing has at least one escaping groove extending from an opening end of the receptacle, and the cam follower has at least one cam pin formed on the surrounding wall of the moving plate and fitting into the escaping groove.

7. The connector of claim 6, further comprising at least one cam pin on the mating housing and passing through the escaping groove and uniting with the cam pin of the moving plate while the two housings are being connected to form and integral cam follower.

8. The connector of claim 5, wherein the movable member is operated while the cam follower is engaged with at least one cam groove of the movable member, whereby the mating housing is connected with the connector housing while moving together with the moving plate.

9. A connector, comprising:

a housing including a receptacle for receiving a mating housing, the receptacle having two opposed sides and two opposed ends extending between and joining the sides to define an inner peripheral surface for the receptacle, ends;

a lever mounted rotatably on at least one of the sides of the housing and configured to assist a connection of the housing with the mating housing; and a moving plate with positioning holes for positioning terminal fittings in the receptacle, a surrounding wall formed around an outer periphery of the bottom wall, the surrounding wall having opposed side walls and opposed end walls extending between the side walls for defining an outer peripheral surface opposed to the inner peripheral surface of the receptacle and configured so that the moving plate is moveable together with the mating housing towards a back side of the receptacle while the housing is being connected to the mating housing, shake preventing projections provided on portions of the outer peripheral surface of the moving plate defined by the end walls, the shake preventing projections being dimensioned for engaging portions of the inner peripheral surface of the receptacle defined by the ends of the receptacle for substantially preventing the moving plate from tilting in the receptacle as the lever is rotated.

10. The connector of claim 9, wherein the lever has two opposed cam grooves, the mating housing configured to engage the lever to assist a connection of the housing.

11. The connector of claim 9, wherein the shake preventing projections are dimensioned to bite in and deform the inner peripheral surface of the receptacle.

12. The connector of claim 10, wherein the housing has two opposed escaping grooves extending from an opening end of the receptacle, and cam pins formed on the surrounding wall of the moving plate and fitting into the escaping grooves.

13. The connector of claim 12, wherein the cam pins on the mating housing are configured for passing through the escaping grooves and uniting with the cam pins of the moving plate while the two housings are being connected to form integral cam followers.

14. The connector of claim 13, wherein the bottom wall is substantially rectangular, the shake preventing projections are provided on sides of the surrounding wall corresponding to shorter sides of the bottom wall, and the cam pins are provided on sides of the surrounding wall corresponding to a longer sides of the bottom wall.

15. The connector of claim 11, wherein the shake preventing projections are elongated ribs of substantially arcuate cross-section.

* * * * *